US010000925B2

(12) United States Patent
Dahlin

(10) Patent No.: US 10,000,925 B2
(45) Date of Patent: Jun. 19, 2018

(54) MOISTURE COLLECTION AND DRAINAGE SYSTEM WITHIN AN EXTERIOR STUCCO WALL CONSTRUCTION

(71) Applicant: David D. Dahlin, Elk Grove, CA (US)

(72) Inventor: David D. Dahlin, Elk Grove, CA (US)

( * ) Notice: Subject to any disclaimer, the term of this patent is extended or adjusted under 35 U.S.C. 154(b) by 0 days. days.

(21) Appl. No.: 15/839,001

(22) Filed: Dec. 12, 2017

(65) Prior Publication Data

US 2018/0100303 A1 Apr. 12, 2018

Related U.S. Application Data

(62) Division of application No. 15/164,816, filed on May 25, 2016, now Pat. No. 9,856,645.

(51) Int. Cl.

| | |
|---|---|
| ***E04B 2/84*** | (2006.01) |
| ***E04B 1/66*** | (2006.01) |
| ***E04B 2/04*** | (2006.01) |
| ***E04B 1/64*** | (2006.01) |

(52) U.S. Cl.

CPC ..... *E04B 2/845* (2013.01); *E04B 1/64* (2013.01); *E04B 1/665* (2013.01); *E04B 2/04* (2013.01)

(58) Field of Classification Search

CPC . E04B 2/845; E04B 1/665; E04B 1/64; E04B 2/04

See application file for complete search history.

(56) References Cited

U.S. PATENT DOCUMENTS

| | | | | |
|---|---|---|---|---|
| 5,410,852 | A * | 5/1995 | Edgar | E04B 1/762 52/408 |
| 5,979,131 | A * | 11/1999 | Remmele | E04B 1/762 156/306.6 |
| 6,355,333 | B1 * | 3/2002 | Waggoner | E04B 1/62 428/174 |
| 6,410,118 | B1 * | 6/2002 | Reicherts | B32B 13/04 428/141 |
| 6,698,144 | B1 * | 3/2004 | Larson | E04B 1/765 52/202 |
| 6,745,531 | B1 * | 6/2004 | Egan | E04B 1/70 52/302.1 |
| 6,807,786 | B1 * | 10/2004 | Peck | E04F 13/02 52/362 |
| 6,886,301 | B2 * | 5/2005 | Schilger | E04C 2/205 52/302.1 |
| 6,990,775 | B2 * | 1/2006 | Koester | E04B 1/70 428/121 |

(Continued)

*Primary Examiner* — Rodney Mintz

(74) *Attorney, Agent, or Firm* — R. Michael West

(57) ABSTRACT

An exterior stucco wall construction comprising: a wall frame; sheathing attached to the outer side of the wall frame; a moisture collection channel mounted along a lower margin of the sheathing and having an inner flange, an outer flange, and a support floor extending therebetween, the collection channel further having a plurality of apertures arranged in spaced relation adjacent and along the inner flange; a vapor barrier attached to the sheathing and covering a portion of the upper flange of the collection channel; a moisture impervious board having an inner side provided with drain means to facilitate the downward drainage of moisture to a lower edge located within the collection channel and resting upon its support floor; lath wire secured over the outer side of the board; and, at least one coat of stucco applied over the lath wire.

14 Claims, 4 Drawing Sheets

(56) References Cited

U.S. PATENT DOCUMENTS

| | | | | |
|---|---|---|---|---|
| 8,051,611 | B2 * | 11/2011 | Serino | E04B 1/762 52/169.14 |
| 8,555,581 | B2 * | 10/2013 | Amend | E04F 13/0875 52/302.1 |
| 8,640,421 | B2 * | 2/2014 | Frobosilo | E04B 1/66 52/169.14 |
| 8,789,329 | B2 * | 7/2014 | Radoane | E04B 2/58 52/309.5 |
| 9,540,808 | B2 * | 1/2017 | Remmele | E04F 13/068 |
| 9,856,645 | B2 * | 1/2018 | Dahlin | E04B 2/845 |
| 2002/0108333 | A1 * | 8/2002 | Clayton | E04B 1/70 52/302.1 |
| 2006/0277854 | A1 * | 12/2006 | Egan | E04B 1/70 52/302.3 |
| 2008/0034690 | A1 * | 2/2008 | Gartz | E04B 1/70 52/302.3 |
| 2011/0258944 | A1 * | 10/2011 | Radoane | E04B 2/58 52/62 |
| 2011/0296781 | A1 * | 12/2011 | McCary | E04C 2/292 52/309.2 |
| 2012/0324814 | A1 * | 12/2012 | Amend | E04F 13/0875 52/302.1 |
| 2016/0069071 | A1 * | 3/2016 | Remmele | E04F 13/068 52/232 |
| 2017/0342709 | A1 * | 11/2017 | Dahlin | E04B 2/845 |

* cited by examiner

MOISTURE COLLECTION AND DRAINAGE SYSTEM WITHIN AN EXTERIOR STUCCO WALL CONSTRUCTION

PRIORITY CLAIM

This Application is a Divisional of pending U.S. Non-Provisional patent application Ser. No. 15/164,816, filed May 25, 2016, and claims the benefit thereof.

BACKGROUND OF THE INVENTION

1. Field of the Invention

The invention relates generally to exterior stucco wall constructions, for residential and business applications. More specifically, the invention pertains to an improved moisture drainage system that prevents waterproofing failure, mold, mildew, and wood rot, associated with conventional exterior stucco wall constructions.

2. Description of the Prior Art

In U.S. Pat. No. 6,355,333, granted to Waggoner et al., a Construction Membrane is taught. The membrane is described as resisting liquid and air penetration, being moisture vapor permeable, and being provided with integral drainage channels. The disclosed exterior wall construction which incorporates this membrane may be faced with stucco, siding, brick, or stone.

An Exterior Building Cladding Having Rigid Foam Layer With Drain Channels is shown in U.S. Pat. No. 6,886,301, granted to Schilger. Both the inside and the outside faces of the rigid foam insulation layer are provided with vertical channels 21 to remove moisture by way of thin channels 22. (See, FIGS. 3 and 4). Exterior water penetration drains to the bottom of channels 22, and exits the wall construction by means of a drain wick 28 and flashing 25.

In Published Patent Application No. US 2011/0296781, owned by McCary, an Insulating Finishable Panel is illustrated. This construction employs a rigid faced foam cored panel, which in one embodiment includes foam air spacers 15 adhered to the panel's radiant reflective surface 14. As in shown in FIG. 2, an air space 18 is thereby provided. In another arrangement, attached foam air spacers 32 create an air space 33 between the insulation 34 and the radiant reflective surface 14.

In Published Patent Application No. US 2008/0034690, owned by Gartz et al., an Underlayment With Improved Drainage is disclosed. The underlayment may include a plurality of vertical channels, 215 and 235, and funnels 370 and 371, at respective top and bottom edges. The funnels are provided to compensate for misalignment of vertically stacked underlayment panels.

Notwithstanding coats of paint and moisture sealant applied to the exterior layer of a stucco wall, moisture still manages to penetrate the stucco over time, and collect on layers of material within the wall. Known prior art construction methods provide moisture barriers and attempt to allow the drainage of accumulated moisture. However, these methods have proven inadequate, and stucco walls continue to fail from moisture intrusion and accumulation, allowing mold to form and causing wood to rot. The exterior stucco wall construction disclosed herein, provides improved drainage of the moisture which has penetrated the wall and collects therein on materials and structures. Improved longevity and integrity of the stucco wall system is thereby provided.

SUMMARY OF THE INVENTION

The exterior stucco wall construction disclosed herein comprises a wall frame, typically including a horizontal sill plate and a plurality of upstanding wall studs. A layer of sheathing is attached to the outer side of the wall frame. The sheathing includes a lower margin extending past the sill plate and over an upper outer edge portion of the supporting slab foundation.

An elongated moisture collection channel is provided. The moisture collection channel has an inner flange attached to the sheathing along its lower margin. The channel also includes an outer flange and a support floor extending between the inner flange and the outer flange. The support floor includes a plurality of apertures extending therethrough, with the apertures being arranged in spaced relation adjacent and along the inner flange of the channel. Preferably, the apertures are elongated, having coincident axes parallel to the inner flange.

A vapor barrier is attached to the outer surface of the sheathing to prevent moisture intrusion. The vapor barrier has a lower portion extending over at least a part of the inner flange, so that any moisture collected on or flowing downwardly on the moisture barrier will be directed into the channel.

A moisture impervious board, preferably manufactured from foam, has an inner side, an outer side, and a lower edge. The inner side of the board comprises a plurality of vertical channels for the downward drainage of moisture. These vertical channels may be defined by undulations in the surface of the inner side. The thickness of the board is defined by the distance between the inner side and the outer side of the board. This thickness is selected to be less than the distance between the inner flange and the outer flange of the collection channel, so that the lower edge of the board can be inserted and located within the collection channel.

Lath wire or its equivalent, is secured over the outer side of the moisture impervious board. At least one coat of stucco is applied over the lath wire and board. Preferably, a first inner coat is applied, known as a brown coat. The brown coat extends into the collection channel, effectively filling the volume between the outer side of the board and the outer flange of the collection channel. Then, a second outer coat is applied over the brown coat. This outer coat is commonly termed the finish coat, and it extends over the entire brown coat and the outer flange of the collection channel.

DETAILED DESCRIPTION OF THE PREFERRED EMBODIMENT

Figure 1:
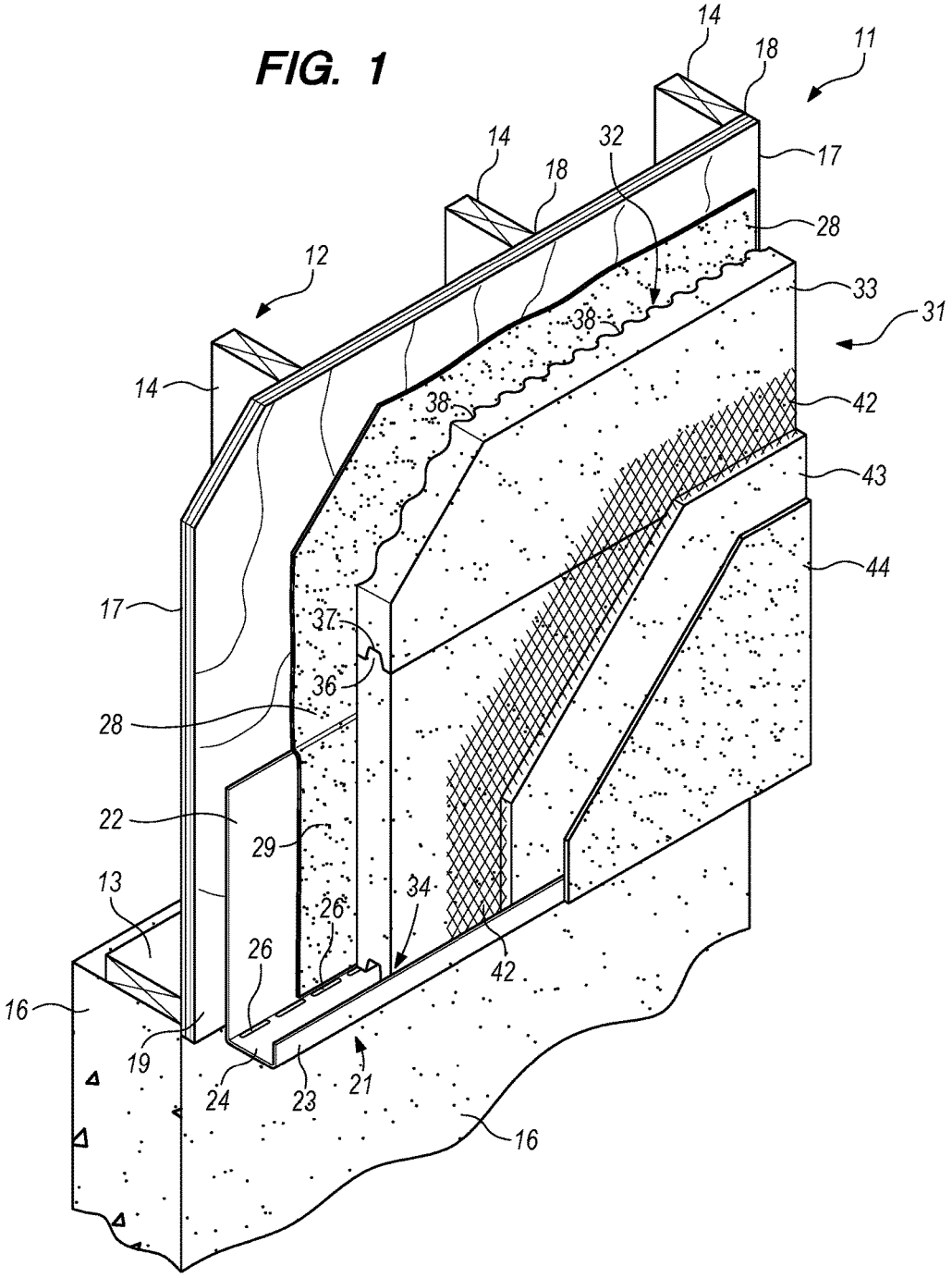
FIG. 1 is a left front perspective view of the stucco wall construction herein, with successive layers of the wall being broken away to show the configuration and relationship of the internal structures and features.

Turning now to the drawings, and in particular FIG. 1, an exterior stucco wall construction 11 is illustrated. A wall frame 12 is provided, in this example, comprising a horizontal sill plate 13 and a plurality of vertical wall studs 14 arranged in spaced relation along sill plate 13 and upstanding therefrom. Sill plate 13 is mounted on and secured to a foundation 16, which may be a poured slab or a stem wall. It is to be understood that FIG. 1 is exemplary of one of many construction methods with which the wall construction 11 may be advantageously incorporated. For example, wall frame 12 could be made from poured concrete, bricks, or metal studs, in lieu of the wooden wall studs 14 which are shown.

A layer of sheathing 17 is attached to an outer side 18 of wall frame 12. Sheathing 17 has a lower margin 19, the lowermost edge thereof typically overlaps a small portion of foundation 16. Sheathing 17 is preferably made from sheets of plywood or OSB (Oriented Strand Board), but could also be comprised of individual pieces of lumber, with tongue and groove, shiplap, or abutting edges.

Figure 3:
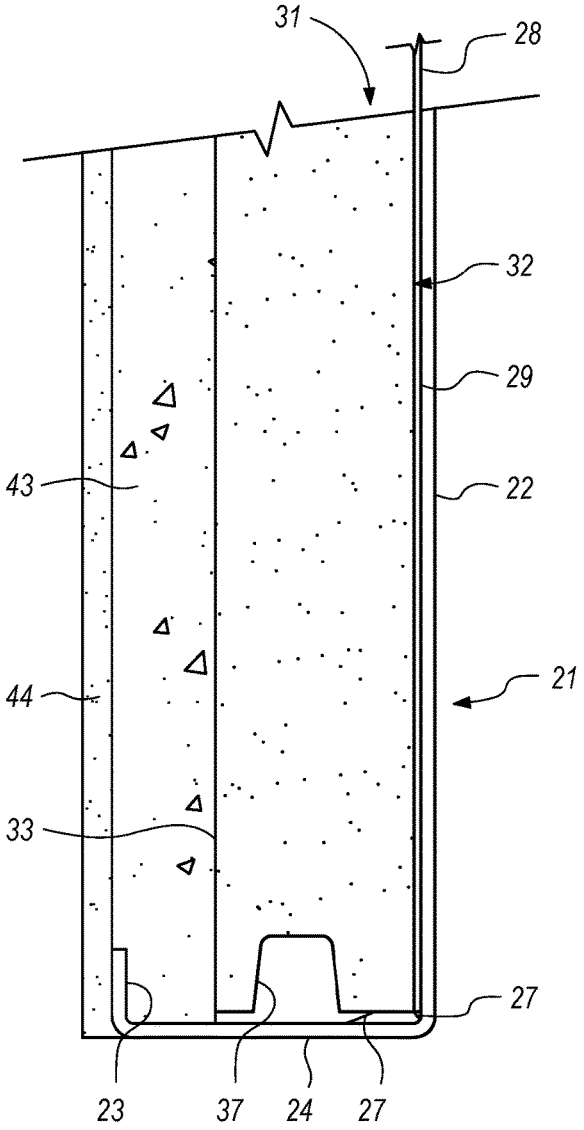
FIG. 3 is a fragmentary end elevational view of the collection channel, showing the board, the inner coat of stucco, and the outer coat of stucco.
Figure 4:
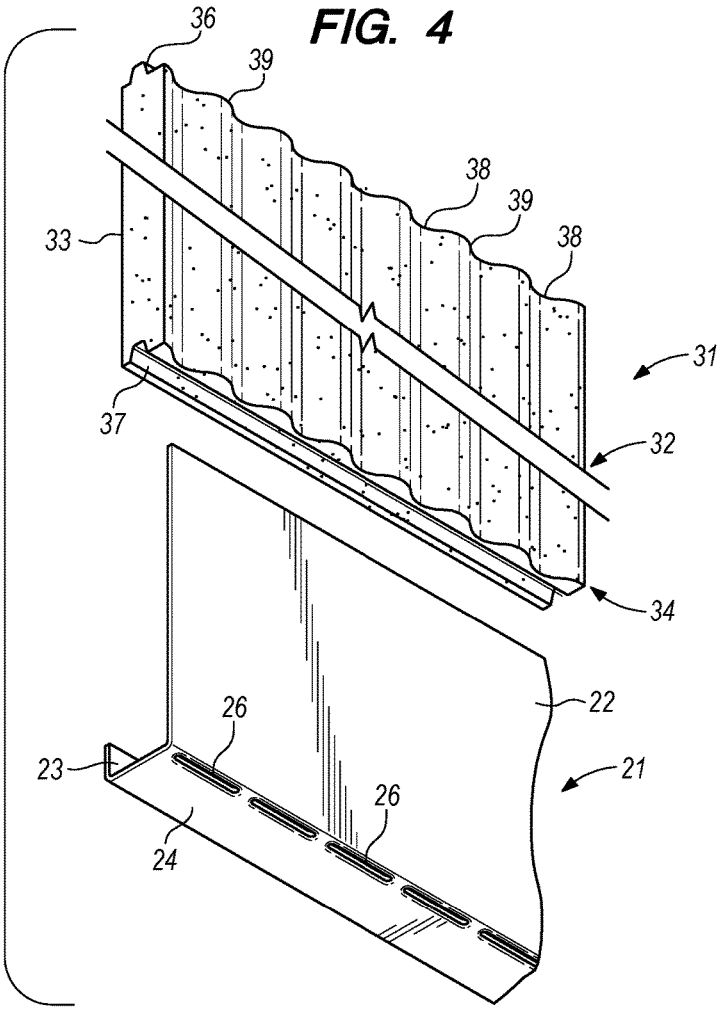
FIG. 4 is an exploded fragmentary perspective view of a board and the collection channel, showing the drainage channels formed by undulations on the inner side of the board and the elongated apertures arranged in the support floor of the collection channel.
Figure 5:
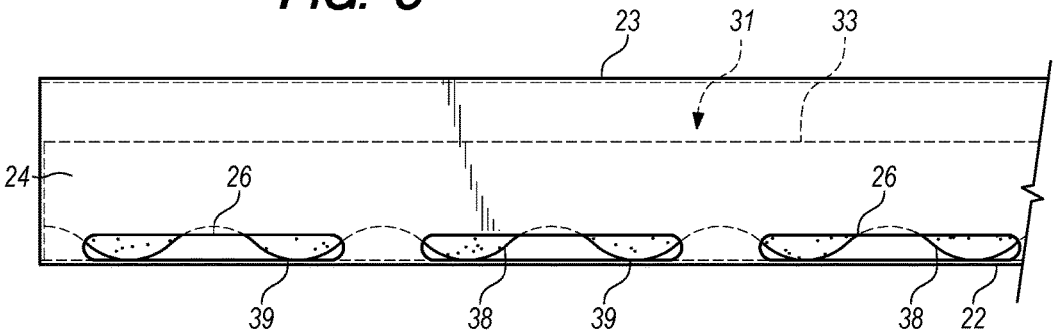
FIG. 5 is a fragmentary bottom plan view of the collection channel with the board located therein, the drainage channels generally being in alignment with the collection channel apertures.

An elongated moisture collection channel 21 includes an inner flange 22, an outer flange 23, and a support floor 24 extending between inner flange 22 and outer flange 23. Inner flange 22 is attached to sheathing 17 along its lower margin 19 by means of conventional fasteners. Support floor 24 includes a plurality of apertures 26 extending therethrough, to allow the passage of moisture downwardly, through floor 24. Apertures 26 are strategically located, and arranged in spaced relation adjacent and along inner flange 22. Preferably, apertures 26 are elongated to maximize their efficiency in passing moisture, as will be explained below. The axes of apertures 26 are coincident, and parallel to inner flange 22, as shown in FIGS. 4 and 5. It should also be noted that apertures 26 are formed by punching a die through floor 24. In this process, upwardly turned burrs 27 are formed, evident in FIG. 3. The function of these burrs 27 will also be explained below.

A vapor barrier 28 is attached to the outer surface of the sheathing 17, as shown in FIG. 1. Vapor barrier 28 has a lower portion 29 extending over at least a part of the inner flange 22. This lower portion 29 ensures that any moisture which collects on vapor barrier 28 and travels downwardly, will be directed into collection channel 21. Vapor barrier 28 may be made from asphaltic building paper, plastic impregnated fiber paper, plastic sheeting, or other equivalent material.

Figure 6:
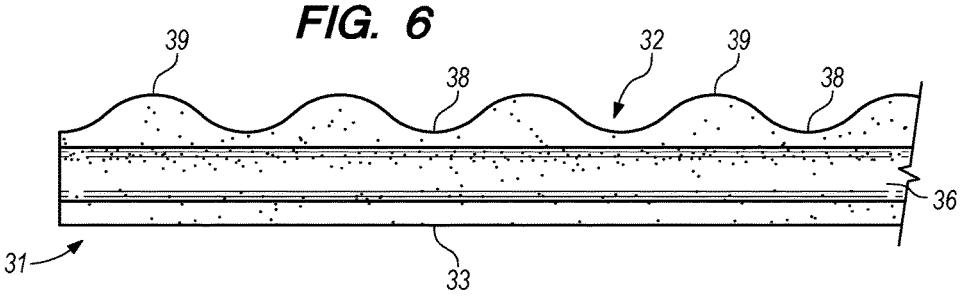
FIG. 6 is a fragmentary top plan view of the board, taken to an enlarged scale, showing the upper tongue and the undulations forming the drainage channels; and, FIG. 7 is a fragmentary inner side elevational view of a board, showing the vertical drainage channels and the upper tongue, the lower groove being shown in broken line.
Figure 7:
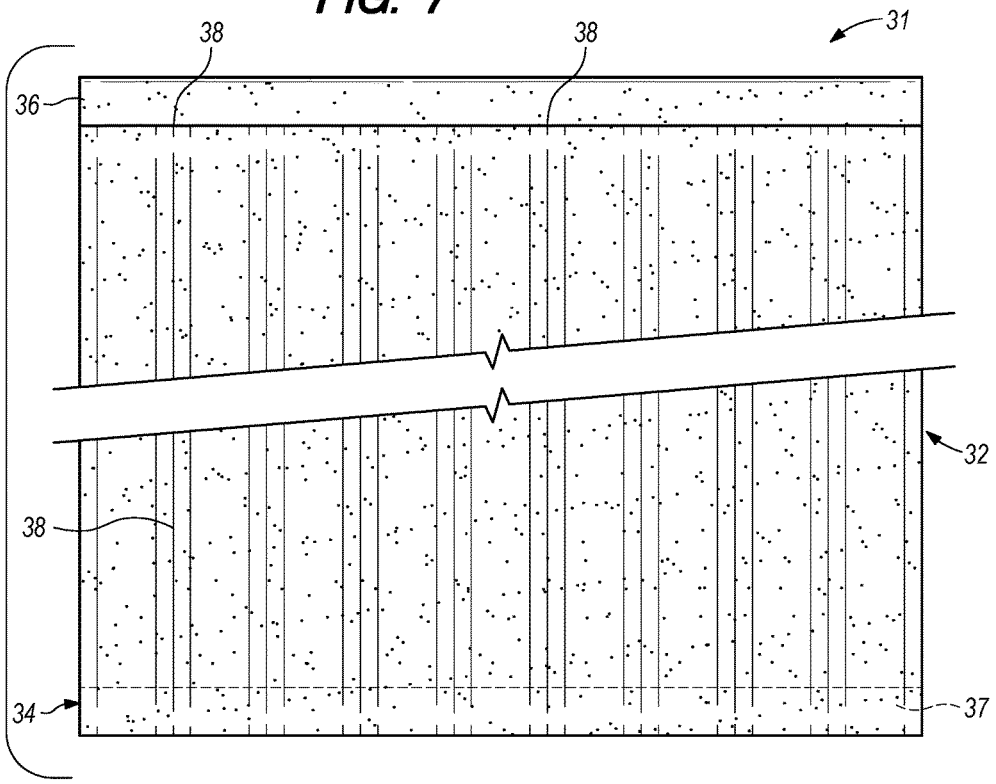

A moisture impervious board 31 is also provided. As shown in FIGS. 4, 6, and 7, board 31 has an inner side 32, an outer side 33, and a lower edge 34. Board 31 is preferably made from foam for its desirable characteristics in this application, being water resistant, light in weight, and inexpensive to manufacture. However, other materials such as plastics, fibrous sheets, or combinations of the two, would also work well.

Figure 2:
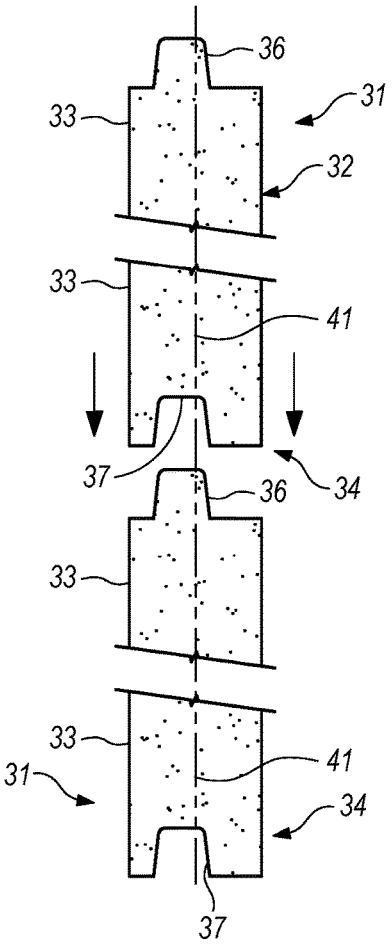
FIG. 2 is a fragmentary representation of two pieces of the foam board, showing the mating relationship of the upper tongue and the lower groove of the respective pieces.

By means of an upper tongue 36 located at the top of board 31, and a lower groove 37 located within lower edge 34, two or more boards 31 may be vertically stacked for additional height in the wall construction 11. This interlocking feature is illustrated in FIGS. 1 and 2, where an upper board 31 is mated with a lower board 31 by inserting groove 37 over tongue 36.

The inner side 32 of board 31 comprises a plurality of vertical channels 38 for the downward drainage of moisture which has collected on inner side 32. Vertical channels 38 are defined by corresponding crests or undulations 39 on either side thereof. Channels 38 may also be straight walled cuts or recesses, but the curved channels are preferred as they are less likely to form stress cracks or break under stress. As is evident from FIG. 2, tongue 36 and groove 37 may also be slightly offset from the longitudinal axis 41 of board 31, to provide a greater thickness in the sidewall of board 31, between the groove 37 and the channels 38.

Between the inner side 32 and the outer side 33, a thickness for board 31 is defined. This thickness is less than the distance between the inner flange 22 and the outer flange 23 of the collection channel 21. This permits the lower edge 34 of board 31 to be located within the collection channel 21 during assembly of the wall construction 11. When board 31 is inserted within collection channel 21, the inner side 32 of board 31 is placed in contingent relation with vapor barrier 28 or with inner flange 22, in the event vapor barrier 28 does not extend to support floor 24. This ensures that the channels 38 will closely align with respective apertures 26 in support floor 24. (See, FIG. 5).

This alignment feature between the channels 38 and the apertures 26 provides the maximum discharge of moisture and condensation, and the maximum flow of air to enhance evaporation of moisture and condensation, through apertures 26. As a final feature of this arrangement, the burrs 27 formed in the floor 24, effectively raise the lower edge 34 of board 31 slightly off the floor 24. This slightly spaced relation between the edge 34 and the floor 24, further enhances drainage and air flow in this region. It is apparent that spacing nubs or protrusions could be placed on the lower portions of edge 34, to provide the same effect. Or, discrete spacers could be placed on or formed into the floor 24 as an equivalent structure.

A lath wire 42 is secured over the outer side 33 of board 31, as shown in FIG. 1. The bottom edge of lath wire 42 preferably extends into the bottom portion of collection channel 21. In the next step of assembling the stucco wall construction 11, at least one coat of stucco is applied over lath wire 42. Preferably, a first inner coat 43, known as a "brown coat", is imbedded into the lath wire 42. This inner coat 43 extends into collection channel 21, and fills whatever void exists between the outer side 33 of board 31 and the outer flange 23. Finally, a second outer coat 44, known as a "finish coat", is applied over the inner coat 43 and the outer flange 23. Details of these final steps are illustrated in FIGS. 1 and 3.

It will be appreciated, then, that I have disclosed the features and structural details of an exterior stucco wall construction with improved moisture drainage.

What is claimed is:

1. A moisture collection and drainage system within an exterior stucco wall construction comprising:

a. an elongated moisture collection channel, said channel having an inner flange, an outer flange, and a support floor extending between said inner flange and said outer flange, said support floor having a plurality of apertures extending therethrough with said apertures being arranged in spaced relation adjacent and along a lower peripheral edge of said inner flange; and b. a moisture impervious board having an inner side, an outer side, and a lower edge, said inner side comprising a plurality of vertical channels for downward drainage of moisture, each of said vertical channels having a lower end located along said lower edge, each of said lower ends overlying and being in registration and substantial alignment with at least one of said apertures, said inner side and said outer side defining aboard thickness therebetween, said lower edge of said board being located within said collection channel.

2. The moisture collection and drainage system of claim 1 in which said moisture impervious board is constructed from foam.

3. The moisture and drainage system of claim 1 in which a plurality of undulations define said vertical channels.

4. The moisture collection and drainage system of claim 1 in which said apertures are elongated in shape, having a longitudinal axis oriented in parallel relation to said inner flange.

5. The moisture collection and drainage system of claim 1 including lath wire secured over said outer side of said board, and at least one coat of stucco applied over said lath wire.

6. The moisture collection and drainage system of claim 5 in which said thickness of said board is less than a distance between said inner flange and said outer flange of said collection channel.

7. The moisture collection and drainage system of claim 6 in which said at least one coat of stucco applied over said lath wire comprises a first inner coat imbedded into said lath wire and extending into said channel between said outer side of said board and said outer flange, and a second outer coat applied over said inner coat and said outer flange.

8. A moisture collection and drainage system within an exterior stucco wall construction comprising:

a. an elongated moisture collection channel, said channel having an inner flange, an outer flange, and a support floor extending between said inner flange and said outer flange, said support floor having a plurality of apertures extending therethrough with said apertures being arranged in spaced relation adjacent and along a lower peripheral edge of said inner flange; and b. a moisture impervious board having an inner side, an outer side, and a lower edge, said inner side comprising drain means for allowing downward drainage of moisture to said lower edge, said drain means having lower ends located along said lower edge, each of said lower ends overlying and being in registration and substantial alignment with at least one of said apertures, said inner side and said outer side defining a board thickness therebetween, said thickness being less than a distance between said inner flange and said outer flange of said collection channel, said lower edge of said board being located within said collection channel.

9. The moisture collection and drainage system of claim 8 in which said moisture impervious board is constructed from foam.

10. The moisture and drainage system of claim 8 in which said drain means comprises a plurality of undulations on said inner side defining vertical channels.

11. The moisture collection and drainage system of claim 8 in which said apertures are elongated in shape, having a longitudinal axis oriented in parallel relation to said inner flange.

12. The moisture collection and drainage system of claim 8 including lath wire secured over said outer side of said board, and at least one coat of stucco applied over said lath wire.

13. The moisture collection and drainage system of claim 12 in which said thickness of said board is less than a distance between said inner flange and said outer flange of said collection channel.

14. The moisture collection and drainage system of claim 13 in which said at least one coat of stucco applied over said lath wire comprises a first inner coat imbedded into said lath wire and extending into said channel between said outer side of said board and said outer flange, and a second outer coat applied over said inner coat and said outer flange.

* * * * *